United States Patent [19]

Wheatley et al.

[11] 4,140,616

[45] Feb. 20, 1979

[54] ELECTROLYTIC CELLS

[75] Inventors: Stuart M. Wheatley, Reading; Geoffrey R. Sherfield, Wokingham; Derek A. Burton, Basingstoke, all of England

[73] Assignee: A. Johnson & Company (London) Limited, London, England

[21] Appl. No.: 832,743

[22] Filed: Sep. 12, 1977

[30] Foreign Application Priority Data

Oct. 15, 1976 [GB] United Kingdom ..... 43024/76

[51] Int. Cl.[2] ..... C25B 1/16; C25B 1/26; C25B 9/00; C25B 9/02

[52] U.S. Cl. ..... 204/268; 204/255; 204/269; 204/270; 204/286; 204/290 R

[58] Field of Search ..... 204/255, 253, 252, 268, 204/290 R, 270, 301, 286, 269

[56] References Cited

U.S. PATENT DOCUMENTS

| | | | |
|---|---|---|---|
| 813,048 | 2/1906 | Levett | 204/290 R X |
| 1,476,251 | 12/1923 | Handy | 204/252 X |
| 1,541,947 | 6/1925 | Hartman et al. | 204/252 X |
| 2,799,643 | 7/1957 | Raetzsch | 204/270 |
| 2,928,783 | 3/1960 | Bacon | 204/290 R X |
| 3,236,692 | 2/1966 | Lewis | 136/86 |
| 3,291,716 | 12/1966 | Cioffi | 204/301 |
| 3,375,184 | 3/1968 | Giacopelli | 204/225 |
| 3,655,548 | 4/1972 | Childs | 204/290 R X |
| 3,669,869 | 6/1972 | Burton | 204/268 |

FOREIGN PATENT DOCUMENTS 178488 4/1922 United Kingdom.

*Primary Examiner*—Arthur C. Prescott
*Attorney, Agent, or Firm*—Finnegan, Henderson, Farabow & Garrett

[57] ABSTRACT

There is disclosed a bipolar electrolytic cell comprising a row of spaced-apart electrodes which include at least one bipolar intermediate electrode. There are an inlet for the supply of electrolyte liquid and an outlet for the discharge of treated liquid, the cell being such that liquid can flow from the inlet to the outlet via a path in which it passes in succession through all the spaces between the electrodes in the row, in each case across the faces of the two electrodes on opposite sides of the space. There is a coating of electrically insulating material on that external surface of each of the electrodes which is on the outside of the row, the insulating material for example being a plastics material such as nylon.

44 Claims, 1 Drawing Figure

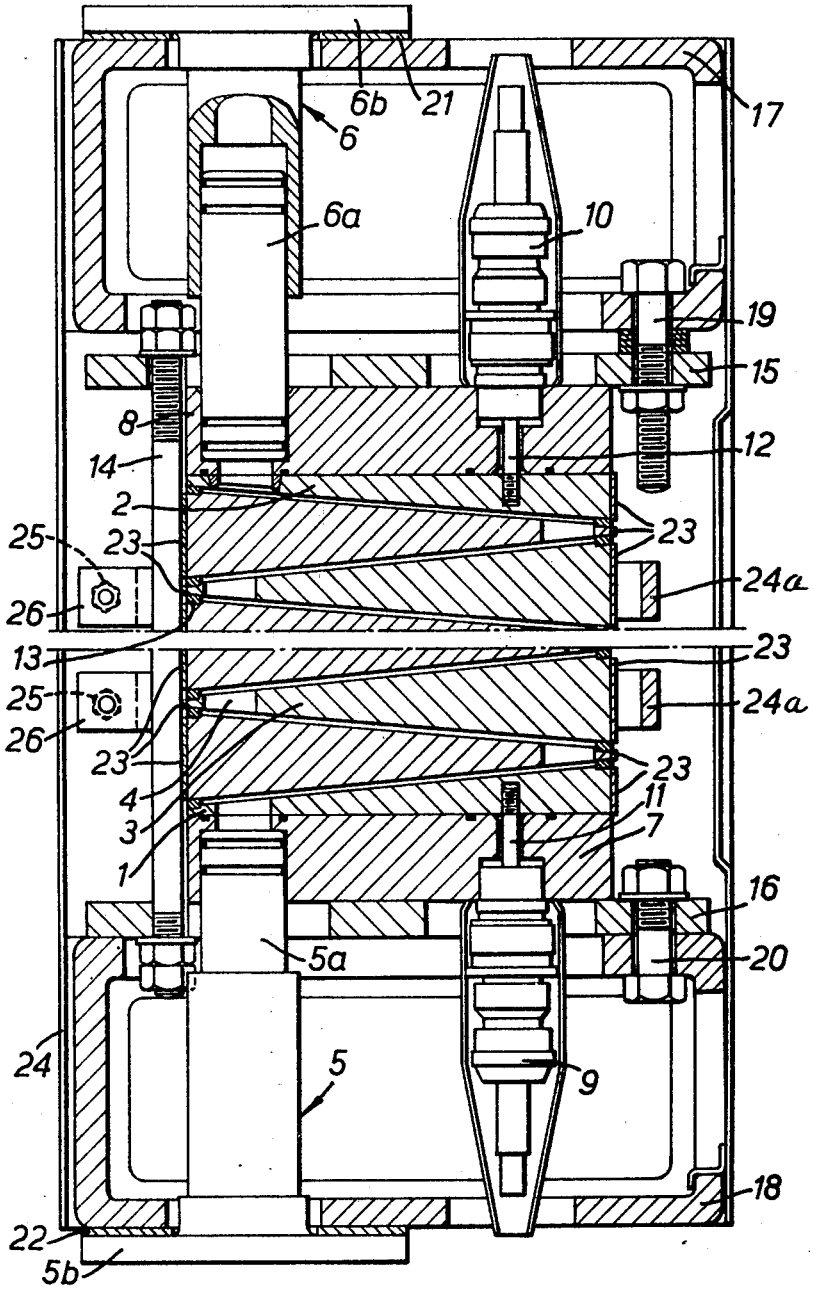
6b
21
17
6
6a
10
19
15
8
12
14
2
23
25
23
24a
26
13
23
25
24a
26
23
23
4
11
3
7
1
16
5a
20
24
5
9
18
22
5b

ELECTROLYTIC CELLS

This invention relates to electrolytic cells,

According to the invention, there is provided a bipolar electrolytic cell including a row of spaced-apart electrodes which include a bipolar intermediate electrode, an inlet for the supply of electrolyte liquid and an outlet for the discharge of treated liquid, the cell being such that liquid can flow from the inlet to the outlet via a path in which it passes in succession through all the spaces between the electrodes in the row, in each case across the faces of the two electrodes on opposite sides of the space, the cell further including a coating of electrically insulating material on that external surface of each of the electrodes which is on the outside of the row.

The cell could, for example, be used for the electrolysis of sodium chloride solution or seawater to form sodium hypochlorite and hydrogen.

The term "bipolar" is used in the art to describe an electrode which has one face which acts as an anode and an opposite face which acts as a cathode and cells containing such electrodes are termed "bipolar" cells. A cell in accordance with the invention could be operated with recirculation of the electrolyte.

The bipolar intermediate electrode could have an anode integral with a cathode, that is to say there is not a body of electrically insulating material with electrically conductive material applied as a layer on the outside of the body. In this case, the electrically conductive material used for the bipolar intermediate electrode could, however, be made up by mixing an electrically conductive substance with an electrically insulating substance. For example, it could be plastics material reinforced throughout with carbon fibres. Alternatively, in the case that the bipolar intermediate electrode has a cathode and an anode integral with one another, it could instead be made of graphite or metal with a cladding which protects the graphite or metal from the electrolyte and is more resistant then it to chemical action which occurs in use of the cell.

The row could be a vertical one. In this case, the inlet is preferably at the bottom of the cell and the outlet at the top of the cell. Preferably, the cell is then such that the said path is a path which is never descending, the lower face of the intermediate electrode and the lower face of the upper electrode being inclined to the horizontal. In this case it is also preferable that upper and lower faces of the intermediate electrode are inclined in opposite senses to the horizontal. Moreover, it is preferable that the upper face of the lower electrode is inclined to the horizontal.

The coating of electrically insulating material on that external surface of each of the electrodes which is on the outside of the row could be for example a plastics material such as nylon.

Preferably, the spaces between the electrodes are interconnected only by holes through the electrodes there being seals which are preferably non-circular in cross-section provided around the edges of the electrodes and in between successive electrodes, the seals being the only means spacing apart the electrodes. Moreover, each of the seals could be partially received in a respective groove in one of the electrodes.

The invention will now be described by way of example with reference to the single FIGURE of the accompanying drawing, which shows a longitudinal section through an electrolytic cell.

The cell has a vertical row of twenty-one wedge-shaped graphite electrodes, there being an anode 1 at the lower end of the row, a cathode 2 at the upper end of the row and nineteen bipolar electrodes 3 each of which acts as a cathode at its lower face and as an anode at its upper face. These bipolar electrodes each has an anode and a cathode integral with one another. All the electrodes are made of graphite and are circular as seen in plan, although they could have other shapes as seen in plan, the electrodes 1 and 2 being similar to one another and having one flat face which is perpendicular to the longitudinal axis of the row of electrodes and an opposite face which is inclined to that axis by an angle other than 90°. The electrodes 3 are similar to one another and each has two opposite faces which are inclined in opposite senses to the aforementioned axis. Each electrode 3 has its thickest part lying between the thinnest parts of the two adjacent electrodes. Each electrode 3 has a hole 4 through it from one flat face to the opposite one and near the thinnest part of the electrode. Each of the electrodes 1 and 2 has a hole through it from one flat face to the opposite one and near the thinnest part of the electrode, these holes communicating with an inlet 5 and an outlet 6 respectively for the supply and discharge of liquid to and from the cell respectively.

The vertical row of electrodes is between a pair of registration plates 7 and 8 serving on the one hand for the registration of the inlet 5 with the hole through the anode and of the outlet 6 with the hole through the cathode; and on the other hand for the registration of an electrical connector 9 with the anode and of an electrical connector 10 with the cathode. The connectors 9 and 10 are electrically connected to the anode 1 and the cathode 2 respectively via tips 11 and 12 screwed into the anode and cathode respectively.

The stack comprising the electrodes and the registration plates 7 and 8 is clamped between two end plates 15 and 16 by means of six nut and bolt arrangements 14 (of which only one can be seen in the FIGURE) there being gaskets 13 of electrically insulating material around the edges of the electrodes and between them, these being the only means spacing apart the electrodes and providing fluid-tight seals to the exterior, being clamped tightly between the electrodes. In the non-compressed states, the gaskets 13 could have ridged electrode engaging faces. The plates 15 and 16 are bolted to top and bottom supports 17 and 18 respectively by four nut and bolt arrangements 19 and four nut and bolt arrangements 20 respectively (of which only one in each case can be seen in the FIGURE). The inlet 5 and the outlet 6 comprise communicating portions **5*a* and 6*a* respectively and connecting portions 5*b* and 6*b* respectively, the latter bearing against the support parts 18 and 17 via gaskets 22 and 21** respectively.

To stop the bolts of the arrangements 14 bowing outwards, there are provided two clamps **24*a* around them, tightened on to the bolts by nut and bolt arrangements 25, each passing through a pair of abutting flanges 26 at the ends of the respective clamp 24*a*. The bolts of the arrangements 14, and the clamps 24*a***, are of plastic coated steel.

Each of the seals 13 is partially received in a groove around the outside of the upper face of the electrode immediately beneath it. This is to stop the seals 13 moving. There are no grooves in the lower faces of the electrodes.

On that external surface of each of the electrodes which is on the outside of the row, there is a thin coating of electrically insulating material, in the example plastics material such as nylon. In the FIGURE, for the sake of clarity, the coatings are indicated by reference numerals 23 and drawn to an exaggerated scale so that they can be seen. The electrodes are provided with the coatings 23 individually by powder deposition, for example, before they are stacked together.

The cell described above is disposed in a cabinet 24 open to the atmosphere, the row of electrodes therefore not being in a housing the interior of which is closed off from the exterior. The coatings 23 serve to prevent voltage breakdowns as a result of this.

Electrolyte flowing through the cell from the inlet to the outlet flows in a never descending path, passing in succession through all the spaces between the electrodes in the row, in each case across the faces of the two electrodes on opposite sides of the space.

Each electrode could be modified by providing the graphite with claddings which protect the graphite from the electrolyte and are more resistant than the graphite to chemical action which occurs in use of the cell, the claddings being provided on the operating faces of the electrode. Instead of using graphite, the electrodes could be made of a metal, for example copper or aluminum, and provided with claddings on their operating faces which protect them from the electrolyte, being more resistant than the metal to chemical action which occurs in use of the cell. Suitable materials for use as the claddings in these cases are titanium for the cathode 2 and the lower faces of the electrodes 3 and titanium covered with a layer of platinum for the anode 1 and the upper faces of the electrodes 3. Security of the cladding in each case may be provided by screwing them on to the electrodes and/or sticking them on with conductive adhesive.

Another possibility is to make each electrode of a plastics material, for example an epoxy or polyester resin, reinforced with carbon fibres.

We claim:

1. A bipolar electrolytic cell including a row of spaced-apart electrodes which include a bipolar intermediate electrode, an inlet for the supply of electrolyte liquid and an outlet for the discharge of treated liquid, the cell being such that liquid can flow from the inlet to the outlet via a path in which it passes in succession through all the spaces between the electrodes in the row, in each case across the faces of the two electrodes on opposite sides of the space, the cell further including a coating of electrically insulating material on that external surface of each of the electrodes which is on the outside of the row.

2. A cell according to claim 1, wherein the spaces between the electrodes are interconnected only by holes through the electrodes, there being seals provided around the edges of the electrodes and in between successive electrodes, the seals being the only means spacing apart the electrodes.

3. A cell according to claim 2, wherein the seals are non-circular in cross-section.

4. A cell according to claim 2, wherein each of the seals is at least partially received in a respective groove in one of the electrodes.

5. A cell according to claim 3, wherein each of the seals is at least partially received in a respective groove in one of the electrodes.

6. A cell according to claim 1, wherein the bipolar intermediate electrode has an anode integral with a cathode.

7. A cell according to claim 2, wherein the bipolar intermediate electrode has an anode integral with a cathode.

8. A cell according to claim 3, wherein the bipolar intermediate electrode has an anode integral with a cathode.

9. A cell according to claim 6, wherein the electrically conductive material used for the bipolar intermediate electrode is a mixture of an electrically conductive substance with an electrically insulating substance.

10. A cell according to claim 7, wherein the electrically conductive material used for the bipolar intermediate electrode is a mixture of an electrically conductive substance with an electrically insulating substance.

11. A cell according to claim 8, wherein the electrically conductive material used for the bipolar intermediate electrode is a mixture of an electrically conductive substance with an electrically insulating substance.

12. A cell according to claim 9, wherein the electrically conductive material is plastics material reinforced throughout with carbon fibers.

13. A cell according to claim 10, wherein the electrically conductive material is plastics material reinforced throughout with carbon fibers.

14. A cell according to claim 11, wherein the electrically conductive material is plastics material reinforced throughout with carbon fibers.

15. A cell according to claim 9, wherein the electrically conductive material used for the bipolar intermediate electrode is graphite with a cladding which protects the graphite from the electrolyte and is more resistant than it to chemical action which occurs in use of the cell.

16. A cell according to claim 10, wherein the electrically conductive material used for the bipolar intermediate electrode is graphite with a cladding which protects the graphite from the electrolyte and is more resistant than it to chemical action which occurs in use of the cell.

17. A cell according to claim 11, wherein the electrically conductive material used for the bipolar intermediate electrode is graphite with a cladding which protects the graphite from the electrolyte and is more resistant than it to chemical action which occurs in use of the cell.

18. A cell according to claim 9, wherein the electrically conductive material used for the bipolar intermediate electrode is metal with a cladding which protects the metal from the electrolyte and is more resistant than it to chemical action which occurs in use of the cell.

19. A cell according to claim 10, wherein the electrically conductive material used for the bipolar intermediate electrode is metal with a cladding which protects the metal from the electrolyte and is more resistant than it to chemical action which occurs in use of the cell.

20. A cell according to claim 11, wherein the electrically conductive material used for the bipolar intermediate electrode is metal with a cladding which protects the metal from the electrolyte and is more resistant than it to chemical action which occurs in use of the cell.

21. A cell according to claim 1, wherein the row is a vertical one.

22. A cell according to claim 2, wherein the row is a vertical one.

23. A cell according to claim 3, wherein the row is a vertical one.

24. A cell according to claim 21, wherein the inlet is at the bottom of the cell and the outlet is at the top of the cell.

25. A cell according to claim 22, wherein the inlet is at the bottom of the cell and the outlet is at the top of the cell.

26. A cell according to claim 23, wherein the inlet is at the bottom of the cell and the outlet is at the top of the cell.

27. A cell according to claim 24, wherein the cell is such that the said path is a path which is never descending, the lower face of the intermediate electrode and the lower face of the upper electrode being inclined to the horizontal.

28. A cell according to claim 25, wherein the cell is such that the said path is a path which is never descending, the lower face of the intermediate electrode and the lower face of the upper electrode being inclined to the horizontal.

29. A cell according to claim 26, wherein the cell is such that the said path is a path which is never descending, the lower face of the intermediate electrode and the lower face of the upper electrode being inclined to the horizontal.

30. A cell according to claim 27, wherein the upper and lower faces of the intermediate electrode are inclined in opposite senses to the horizontal.

31. A cell according to claim 28, wherein the upper and lower faces of the intermediate electrode are inclined in opposite senses to the horizontal.

32. A cell according to claim 29, wherein the upper and lower faces of the intermediate electrode are inclined in opposite senses to the horizontal.

33. A cell according to claim 27, wherein the upper face of the lower electrode is inclined to the horizontal.

34. A cell according to claim 28, wherein the upper face of the lower electrode is inclined to the horizontal.

35. A cell according to claim 29, wherein the upper face of the lower electrode is inclined to the horizontal.

36. A cell according to claim 1, wherein the coating of electrically insulating material on that external surface of each of the electrodes which is on the outside of the row, is a plastics material.

37. A cell according to claim 2, wherein the coating of electrically insulating material on that external surface of each of the electrodes which is on the outside of the row, is a plastics material.

38. A cell according to claim 3, wherein the coating of electrically insulating material on that external surface of each of the electrodes, which is on the outside of the row, is a plastics material.

39. A cell according to claim 36, wherein the plastics material is nylon.

40. A cell according to claim 37, wherein the plastics material is nylon.

41. A cell according to claim 38, wherein the plastics material is nylon.

42. A cell according to claim 1, wherein there is a plurality of such bipolar intermediate electrodes.

43. A cell according to claim 2, wherein there is a plurality of such bipolar intermediate electrodes.

44. A cell according to claim 3, wherein there is a plurality of such bipolar intermediate electrodes.

* * * * *